US007790659B2

(12) United States Patent
Yagishita et al.

(10) Patent No.: US 7,790,659 B2
(45) **Date of Patent: *Sep. 7, 2010**

(54) LUBRICATING OIL COMPOSITIONS

(75) Inventors: Kazuhiro Yagishita, Yokohama (JP); Akira Yaguchi, Yokohama (JP)

(73) Assignee: Nippon Oil Corporation, Tokyo (JP)

( * ) Notice: Subject to any disclaimer, the term of this patent is extended or adjusted under 35 U.S.C. 154(b) by 586 days.

This patent is subject to a terminal disclaimer.

(21) Appl. No.: 11/019,989

(22) Filed: Dec. 22, 2004

(65) Prior Publication Data

US 2005/0107269 A1 May 19, 2005

Related U.S. Application Data

(63) Continuation of application No. PCT/JP03/08338, filed on Jun. 30, 2003.

(30) Foreign Application Priority Data

Jun. 28, 2002 (JP) ..... 2002-191090
Jun. 28, 2002 (JP) ..... 2002-191091
Jun. 28, 2002 (JP) ..... 2002-191092

(51) Int. Cl.
*C10M 141/10* (2006.01)

(52) U.S. Cl. ..... 508/371; 508/287; 508/364; 508/375; 508/378; 508/379; 508/518

(58) Field of Classification Search ..... 508/371, 508/378, 433, 436, 441
See application file for complete search history.

(56) References Cited

U.S. PATENT DOCUMENTS 5,744,430 A * 4/1998 Inoue et al. ..... 508/295
5,895,779 A * 4/1999 Boffa ..... 508/555
6,172,013 B1 * 1/2001 Holt et al. ..... 508/364
6,500,786 B1 * 12/2002 Hartley et al. ..... 508/365
6,562,765 B1 * 5/2003 Boffa ..... 508/221
6,569,818 B2 * 5/2003 Nakazato et al. ..... 508/185
6,569,819 B2 * 5/2003 Yagishita et al. ..... 508/291
6,583,092 B1 * 6/2003 Carrick et al. ..... 508/198
6,617,286 B2 9/2003 Sato et al.
6,656,887 B2 * 12/2003 Yagishita et al. ..... 508/371
6,723,685 B2 * 4/2004 Hartley et al. ..... 508/365
6,764,982 B2 * 7/2004 Bardasz et al. ..... 508/293
6,777,378 B2 * 8/2004 Abraham et al. ..... 508/185
6,852,679 B2 * 2/2005 Hartley et al. ..... 508/365
6,855,675 B1 * 2/2005 Yamada et al. ..... 508/365

FOREIGN PATENT DOCUMENTS

EP 1 167 497 A2 1/2002
JP 07-126680 A 5/1995
JP 09-111275 A 4/1997
JP 2000-119680 A 4/2000
JP 2001-214184 A 8/2001
JP 2001-311090 A 11/2001
JP 2001-342486 A 12/2001
JP 2003-041283 A 2/2003
JP 2003-165992 A 6/2003

* cited by examiner

*Primary Examiner*—Ellen M McAvoy
(74) *Attorney, Agent, or Firm*—Panitch Schwarze Belisario & Nadel LLP

(57) ABSTRACT

Disclosed are lubricating oil compositions excellent in friction reducing effect and long drain properties and particularly suitable for internal combustion engines, which comprise a lubricating base oil, a specific phosphorus compound in an amount of 0.005 to 0.5 percent by mass in terms of phosphorus based on the total mass of the composition, and at least one additive selected from the group consisting of (C) metallic detergents, (D) ashless dispersants, and (E) anti-oxidants, and further contains (F) a sulfur-containing organic molybdenum complex and (G) an ashless friction modifier and which satisfy prescribed requirements and have a sulfated ash content not exceeding a specified level.

16 Claims, No Drawings

LUBRICATING OIL COMPOSITIONS

CROSS-REFERENCE TO RELATED APPLICATION

This application is a continuation of International Application No. PCT/JP2003/008338, filed Jun. 30, 2003, which was published in the Japanese language on Jan. 8, 2004, under International Publication No. WO 2004/003117 A1, the disclosure of which is incorporated herein by reference.

FIELD OF THE INVENTION

The present invention relates to lubricating oil compositions, and more particularly to those with excellent low friction properties and enhanced long-drain properties, particularly suitable for internal combustion engines.

BACKGROUND OF THE INVENTION

Lubricating oils have been conventionally used in internal combustion engines and automatic transmissions for making them work smoothly. Particularly, lubricating oils for internal combustion engines (engine oils) have been required to have high characteristic performances due to the fact that recent developed engines have been improved in performances, increased in power output and used under more sever operation conditions. Therefore, conventional engine oils are blended with various additives such as anti-wear agents, metallic detergents, ashless dispersants, and anti-oxidants for fulfilling the required performances. Since fuel efficient engine oils are large in energy loss at friction parts of engines where the oils are involved, sulfur-containing organic molybdenum compounds such as molybdenum dithiocarbamate and molybdenum dithiophosphate have been preferably used as measures for friction loss or fuel efficiency decrease because these compounds exhibit excellent friction reducing effects. In order to make these compounds fully exhibit such friction reducing effects, a method has generally been employed wherein the compounds are used in combination with a sulfur-containing compound such as zinc dithiophosphate in a rather larger amount such that a molybdenum disulfide film is formed on sliding surfaces of an engine. Furthermore, it is generally known that metallic detergents such as salicylate-based detergents can exhibit friction decreasing effects more with the increase of the amount. However, it has not been fully studied to decrease the metal (decreased ash content) and sulfur contents of conventional low friction lubricating oils such as fuel efficient engine oils. It has been realized that sulfur-containing compounds as described above are significant in effects to improve oxidation stability while they invite the depletion of organic molybdenum compounds or metallic detergents under the influence of sulfuric acid resulting from the deterioration or decomposition of themselves and thus that there is a limit to maintain the initial low friction characteristics for a long period of time. That is, conventional techniques had a limit to provide an engine oil which has excellent low friction properties and can achieve low ash and sulfur contents and improved long-drain properties more than before.

On the one hand, lubricating oils have been required to be decreased in not only ash and sulfur contents but also phosphorus contents so as to reduce harmful influences on recent-developed exhaust-gas purifying catalysts such as ternary catalysts, NOx adsorbers, and oxidation catalysts or exhaust-gas after-treatment devices such as exhaust gas recycle devices (EGR) and diesel particulate filters (DPF) as much as possible.

The present invention was made in view of the foregoing requirements and intends to provide a lubricating oil composition having both low friction properties and long-drain properties such as oxidation stability and base number retention properties, particularly suitable for internal combustion engines.

DISCLOSURES OF THE INVENTION

The present invention was accomplished as a result of the inventors' extensive studies on the foregoing objects.

That is, the present invention relates to a lubricating oil composition comprising a base oil; at least one type of phosphorus compound selected from the group consisting of (A) phosphorus compounds represented by formulas (1) and (2) below and metal- and amine-salts thereof, and (B) zinc dithiophosphates, in an mount of 0.005 to 0.5 percent by mass in terms of phosphorus based on the total mass of the composition; and at least one type of additive selected from the group consisting of (C) metallic detergents, (D) ashless dispersants, and (E) anti-oxidants:

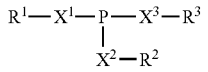

(1)

wherein $X^1$, $X^2$, and $X^3$ are each independently oxygen or sulfur provided that at least two of them are oxygen, and $R^1$, $R^2$, and $R^3$ are each independently hydrogen or a hydrocarbon group having 1 to 30 carbon atoms; and

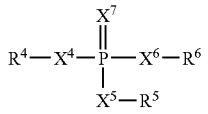

(2)

wherein $X^4$, $X^5$, $X^6$, and $X^7$ are each independently oxygen or sulfur provided that at least three of them are oxygen, and $R^4$, $R^5$, and $R^6$ are each independently hydrogen or hydrocarbon group having 1 to 30 carbon atoms; the composition fulfilling one requirement selected from the group consisting of the following requirements:

(I) the composition contains a phosphorus compound selected from Components (A) as the main component and sulfated ash in an amount of 0.8 percent by mass or less;

(II) the composition contains a phosphorus compound selected from Components (A) as the main component, (F) a sulfur-containing organic molybdenum complex in an amount of 0.001 to 0.2 percent by mass in terms of molybdenum based on the total mass of the composition, and sulfated ash in amount of 1.2 percent by mass or less;

(III) the composition contains a phosphorus compound selected from Components (A) as the main component, (G) an ashless friction modifier, and sulfated ash in an amount of 1.2 percent by mass or less; and (IV) the composition contains a phosphorus compound selected from Components (B) in an amount of 0.05 percent by mass or less in terms of phosphorus based on the total mass of the composition as the main component, (G) an ashless friction modifier, and sulfated ash in an amount of 1.2 percent by mass or less.

The present invention also relates to a method of lubricating an internal combustion engine equipped with a direct striking bucket type or roller follower-type valve train system wherein any of the above-described lubricating oil composition is contacted with such a valve train system.

The present invention will be described in more detail below.

No particular limitation is imposed on lubricating base oils used in the present invention. Therefore, any conventional mineral and/or synthetic base oils used for lubricating oils may be used.

Specific examples of mineral base oils include those which can be obtained by subjecting a lubricating oil fraction produced by vacuum-distilling a topped crude resulting from atmospheric distillation of a crude oil, to any one or more treatments selected from solvent deasphalting, solvent extraction, hydrocracking, solvent dewaxing, and hydrorefining; wax-isomerized mineral oils; and those obtained by isomerizing GTL WAX (Gas to Liquid Wax).

Although no particular limitation is imposed on the total aromatic content of mineral base oils, it is preferably 10 percent by mass or less, more preferably 6 percent by mass or less, further more preferably 3 percent by mass or less, and particularly preferably 2 percent by mass or less. A base oil of a total aromatic content exceeding 15 percent by mass is not preferable because the oxidation stability of the resulting lubricating oil composition would be poor.

The term "total aromatic content" used herein denotes an aromatic fraction content determined in accordance with ASTM D2549. The aromatic fraction includes alkylbenzenes; alkylnaphthalens; anthracene, phenanthrene, and alkylated products thereof; compounds wherein four or more benzene rings are condensated to each other; and compounds having heteroaromatics such as pyridines, quinolines, phenols, and naphthols.

Although no particular limitation is imposed on the sulfur content of mineral base oils, it is preferably 0.05 percent by mass or less, more preferably 0.01 percent by mass or less, and particularly preferably 0.005 percent by mass or less. A lubricating oil composition with more excellent long drain properties can be obtained by decreasing the sulfur content of a mineral base oil. When such a low sulfur lubricating oil composition is used for internal combustion engines, it can avoid harmful influences on exhaust-gas after treatment devices as much as possible.

Specific examples of synthetic lubricating base oils include polybutenes and hydrides thereof; poly-α-olefins such as 1-octene oligomer and 1-decene oligomer, and hydrides thereof; diesters such as ditridecyl glutarate, di-2-ethylhexyl adipate, diisodecyl adipate, ditridecyl adipate, and di-2-ethylhexyl cebacate; polyol esters such as neopentyl glycol ester, trimethylolpropane caprylate, trimethylolpropane pelargonate, pentaerythritol-2-ethyl hexanoate, and pentaerythritol pelargonate; aromatic synthetic oils such as alkylnaphthalenes, alkylbenzenes, and aromatic esters; and mixtures thereof.

Any one of the above-described mineral base oils or synthetic base oils or a mixture of two or more types selected from these base oils may be used in the present invention. For example, the base oil used in the present invention may be one or more of the mineral base oils or synthetic base oils or a mixed oil of one or more of the mineral base oils and one or more of the synthetic base oils.

Although no particular limitation is imposed on the kinematic viscosity at 100° C. of the lubricating base oil used in the present invention, it is preferably 20 $mm^2/s$ or lower, more preferably 10 $mm^2/s$ or lower and preferably 1 $mm^2/s$ or higher, more preferably 2 $mm^2/s$ or higher. A lubricating base oil with a kinematic viscosity at 100° C. exceeding 20 $mm^2/s$ is not preferable because the low temperature viscosity characteristics of the resulting lubricating oil composition would be deteriorated, while that with a kinematic viscosity at 100° C. of less than 1 $mm^2/s$ is not also preferable because the resulting lubricating oil composition would be poor in lubricity due to its insufficient oil film formation capability at lubricated sites and large in evaporation loss of the base oil.

The evaporation loss of the base oil used in the present invention is preferably 20 percent by mass or less, more preferably 16 percent by mass or less, and particularly preferably 10 percent by mass or less, as measured by NOACK evaporation analysis. A lubricating base oil with a NOACK evaporation loss exceeding 20 percent by mass is not preferable because the resulting lubricating oil composition would be large in evaporation loss of the base oil and the sulfur compounds, phosphorus compounds or metals in the composition would accumulate on an exhaust gas purifying device together with the base oil if the composition is used as an internal combustion engine lubricating oil and thus would adversely affect the exhaust gas purifying performance. The term "NOACK evaporation" used herein is defined as the amount of a sample lubricating oil of 60 g, which is lost when the oil is retained at a temperature of 250° C. and a pressure of 20 $mmH_2O$ (196 Pa) for one hour in accordance with ASTM D 5800.

Although no particular limitation is imposed on the viscosity index of the lubricating base oil used, it is preferably 80 or higher, more preferably 100 or higher, and further more preferably 120 or higher so as to be able to obtain excellent viscosity characteristics ranging from low temperatures to high temperatures. A lubricating base oil with a viscosity index of less than 80 is not preferable because the low temperature viscosity characteristics of the resulting lubricating oil composition would be deteriorated.

Component (A) of the lubricating oil composition of the present invention is at least one type of phosphorus compound (phosphorus-containing anti-wear agent) selected from the group consisting of phosphorus compounds represented by formulas (1) and (2), and metal- and amine-salts thereof:

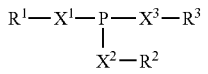

(1)

wherein $X^1$, $X^2$, and $X^3$ are each independently oxygen or sulfur provided that at least two of them are oxygen, and $R^1$, $R^2$, and $R^3$ are each independently hydrogen or a hydrocarbon group having 1 to 30 carbon atoms; and

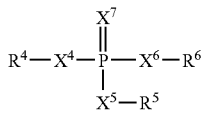

(2)

wherein $X^4$, $X^5$, $X^6$, and $X^7$ are each independently oxygen or sulfur provided that at least three of them are oxygen, and $R^4$, $R^5$, and $R^6$ are each independently hydrogen or hydrocarbon group having 1 to 30 carbon atoms.

Specific examples of the hydrocarbon groups for $R^1$ to $R^6$ include alkyl, cycloalkyl, alkenyl, alkyl-substituted cycloalkyl, aryl, alkyl-substituted aryl, and arylalkyl groups.

Examples of the alkyl group include straight-chain or branched alkyl groups such as methyl, ethyl, propyl, butyl, pentyl, hexyl, heptyl, octyl, nonyl, decyl, undecyl, dodecyl, tridecyl, tetradecyl, pentadecyl, hexadecyl, heptadecyl, and octadecyl groups.

Examples of the cycloalkyl group include those having 5 to 7 carbon atoms, such as cyclopentyl, cyclohexyl, and cycloheptyl groups. Examples of the alkylcycloalkyl groups include those having 6 to 11 carbon atoms, such as methylcyclopentyl, dimethylcyclopentyl, methylethylcyclopentyl, diethylcyclopentyl, methylcyclohexyl, dimethylcyclohexyl, methylethylcyclohexyl, diethylcyclohexyl, methylcycloheptyl, dimethylcycloheptyl, methylethylcycloheptyl, and diethylcycloheptyl groups, of which the alkyl groups may bond to any position of the cycloalkyl groups.

Examples of the alkenyl group include butenyl, pentenyl, hexenyl, heptenyl, octenyl, noneyl, decenyl, undecenyl, dodecenyl, tridecenyl, tetradecenyl, pentadecenyl, hexadecenyl, heptadecenyl, and octadecenyl groups, all of which may be straight-chain or branched and the position of which the double bonds may vary.

Examples of the aryl group include phenyl and naphtyl groups. Examples of the alkylaryl group include those having 7 to 18 carbon atoms, such as tolyl, xylyl, ethylphenyl, propylphenyl, butylphenyl, pentylphenyl, hexylphenyl, heptylphenyl, octylphenyl, nonylphenyl, decylphenyl, undecylphenyl, and dodecylphenyl groups, of which the alkyl groups may be straight-chain or branched and may bond to any position of the aryl groups.

Examples of the arylalkyl groups include those having 7 to 12 carbon atoms, such as benzyl, phenylethyl, phenylpropyl, phenylbutyl, phenylpentyl, and phenylhexyl groups, of which the alkyl groups may be straight-chain or branched.

Hydrocarbon groups having 1 to 30 carbon atoms for $R^1$ to $R^6$ are preferably alkyl groups having 1 to 30 carbon atoms or aryl groups having 6 to 24 carbon atoms, more preferably alkyl groups having 3 to 18 carbon atoms, and further more preferably alkyl groups having 4 to 12 carbon atoms.

Examples of phosphorus compounds represented by formula (1) include phosphorous acid; monothiophosphorus acid; phosphorus acid monoesters and monothiophosphorus acid monoesters, each having one of the above described hydrocarbons having 1 to 30 carbon atoms; phosphorus acid diesters and monothiophosphorus acid diesters, each having two of the above described hydrocarbons having 1 to 30 carbon atoms; phosphorus acid triesters and monothiophosphorus acid triesters, each having three of the above described hydrocarbons having 1 to 30 carbon atoms; and mixtures thereof.

In the present invention, all of $X^1$ to $X^3$ in formula (1) are preferably oxygen.

Examples of phosphorus compounds represented by formula (2) include phosphoric acid; monothiophosphoric acid; phosphoric acid monoesters and monothiophosphoric acid monoesters, each having one of the above described hydrocarbons having 1 to 30 carbon atoms; phosphoric acid diesters and monothiophosphoric acid diesters, each having two of the above described hydrocarbons having 1 to 30 carbon atoms; phosphoric acid triesters and monothiophosphoric acid triesters, each having three of the above described hydrocarbons having 1 to 30 carbon atoms; and mixtures thereof.

In the present invention, all of $X^4$ to $X^7$ in formula (2) are preferably oxygen.

Examples of metal- and amine-salts of phosphorus compounds represented by formulas (1) and (2) include salts obtained by allowing a metal base such as a metal oxide, a metal hydroxide, a metal carbonate and a metal chloride or a nitrogen-containing compound such as ammonia and an amine compound having in its molecules only a hydrocarbon group having 1 to 30 carbon atoms or a hydroxyl group-containing hydrocarbon group having 1 to 30 carbon atoms to react with a phosphorus compound so as to neutralize part or whole of the remaining acid hydrogen.

Specific examples of the metals of the above-mentioned metal bases include alkali metals such as lithium, sodium, potassium, and cesium, alkaline earth metals such as calcium, magnesium, and barium, and heavy metals such as zinc, copper, iron, lead, nickel, silver, manganese, and molybdenum. Among these metals, preferred are an alkali metal such as lithium, alkaline earth metals such as magnesium and calcium, and a heavy metal such as zinc.

The above-described metal salts of the phosphorus compounds vary in structure depending on the valence of metals and the number of OH or SH group of the phosphorus compounds. Therefore, no particular limitation is imposed on the structure of the metal salts of the phosphorus compounds. For example, when 1 mol of zinc oxide is reacted with 2 mol of a phosphoric acid diester (with one OH group), it is assumed that a compound with a structure represented by the formula below is obtained as the main component but polymerized molecules may also exist:

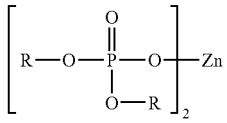

For another example, when 1 mol of zinc oxide is reacted with 1 mol of a phosphoric acid monoester (with two OH groups), it is assumed that a compound with a structure represented by the formula below is obtained as the main component but polymerized molecules may also exist:

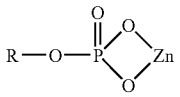

Specific examples of the nitrogen-containing compound include ammonia, monoamines, diamines, and polyamines. More specific examples include alkylamines having a straight-chain or branched alkyl group having 1 to 30 carbon atoms, such as methylamine, ethylamine, propylamine, butylamine, pentylamine, hexylamine, heptylamine, octylamine, nonylamine, decylamine, undecylamine, dodecylamine, tridecylamine, tetradecylamine, pentadecylamine, hexadecylamine, heptadecylamine, octadecylamine, dimethylamine, diethylamine, dipropylamine, dibutylamine, dipentylamine, dihexylamine, diheptylamine, dioctylamine, dinonylamine, didecylamine, diundecylamine, didodecylamine, ditridecylamine, ditetradecylamine, dipentadecylamine, dihexadecylamine, diheptadecylamine, dioctadecylamine, methylethylamine, methylpropylamine, methylbutylamine, ethylpropylamine, ethylbutylamine, and propylbutylamine; alkenylamines having a straight-chain or branched alkenyl group having 2 to 30 carbon atoms, such as ethenylamine, propenylamine, butenylamine, octenylamine, and oleylamine; alkanolamines having a straight-chain or branched alkanol group having 1 to 30 carbon atoms, such as methanolamine, ethanolamine, propanolamine, butanolamine, pentanolamine, hexanolamine, heptanolamine, octanolamine, nonanolamine, methanolethanolamine, methanolpropanolamine, methanolbutanolamine, ethanolpropanolamine, ethanolbutanolamine, and propanolbutanolamine; alkylenediamines having an alkylene group having 1 to 30 carbon atoms, such as methylenediamine, ethylenediamine, propylenediamine, and butylenediamine; polyamines such as diethylenetriamine, triethylenetetramine, tetraethylenepentamine, and pentaethylenehexamine; heterocyclic compounds such as those having an alkyl or alkenyl group having 8 to 20 carbon atoms bonded to the above-exemplified monoamines, diamines and polyamines, specifically undecyldiethylamine, undecyldiethanolamine, dodecyldipropanolamine, oleyldiethanolamine, oleylpropylenediamine, and stearyltetraethylenepentamine and N-hydroxyethyloleylimidazoline; alkyleneoxide adducts thereof; and mixtures thereof.

Among these nitrogen-containing compounds, preferred examples include aliphatic amines having an alkyl or alkenyl group having 10 to 20 carbon atoms, which may be straight-chain or branched, such as decylamine, dodecylamine, dodecyldimethylamine, tridecylamine, heptadecylamine, octadecylamine, oleylamine, and stearylamine.

Among the above-described Components (A), preferred are salts of phosphorus acid diesters having two alkyl or aryl groups having 3 to 18 carbon atoms and zinc or calcium; phosphorus acid triesters having three alkyl or aryl groups having 3 to 18 carbon atoms, preferably three alkyl groups having 6 to 12 carbon atoms; salts of phosphoric acid monoesters having one alkyl or aryl group having 3 to 18 carbon atoms and zinc or calcium; salts of phosphoric acid diesters having two alkyl or aryl group having 3 to 18 carbon atoms and zinc or calcium; and phosphoric acid triesters having three alkyl or aryl groups having 3 to 18 carbon atoms, preferably three alkyl groups having 6 to 12 carbon atoms.

One or more types of compound among Components (A) may be arbitrarily blended.

The content of Component (A) in the lubricating oil composition of the present invention is 0.005 percent by mass or more, preferably 0.01 percent by mass or more, and particularly preferably 0.02 percent by mass or more, in terms of phosphorus based on the total mass of the composition, while the content is 0.5 percent by mass or less, preferably 0.2 percent by mass or less, more preferably 0.1 percent by mass or less, and furthermore preferably 0.08 percent by mass or less. Component (A) of less than 0.005 percent by mass in terms of phosphorus is not effective in anti-wear properties, while Component (A) of more than 0.5 percent by mass when used in an internal combustion engine would possibly adversely affect an exhaust-gas after-treatment device. Component (A) of 0.08 percent by mass or less, particularly 0.05 percent by mass or less is particularly preferred because it can reduce adverse affects on an exhaust-gas after-treatment device.

Although among the above-described Components (A) the lubricating oil composition may contain a sulfur-containing compound within the range of the above-described phosphorus amount, the composition contains preferably 0.1 percent by mass or less and more preferably 0.08 percent by mass or less, in terms of sulfur of the compound. Most preferably the composition contains no sulfur-containing compound.

In the case of selecting a compound insoluble or less soluble in a lubricating oil, such as zinc dialkylphosphate which is solid at ordinary temperature, from Components (A), it is particularly preferred that the compound is mixed with and dissolved in or reacted with an amine compound such as Component (D), the above-described nitrogen compound, an amine-based anti-oxidant selected from Components (E) or a mixture thereof and the resulting dissolved or reaction product is blended with the lubricating oil composition as an oil soluble additive, with the objective of improving the solubility of Component (A) in a lubricating oil and shortening the manufacturing time of the lubricating oil composition. Such an oil soluble additive may be produced by a method wherein Component (A) and an amine compound are mixed and dissolved or reacted in an organic solvent such as hexane, toluene, or decalin at a temperature of 15 to 150° C., preferably 30 to 120° C., and particularly preferably 40 to 90° C. for a period of 10 minutes to hours, preferably 20 minutes to 3 hours, and particularly preferably 30 minutes to one hour and the solvent is vacuum-distilled.

Components (B) of the lubricating oil composition of the present invention are zinc dithiophosphates (ZDTP) and more specifically include zinc dialkyldithiophosphates having a straight-chain or branched (primary, secondary or tertiary, preferably primary or secondary) alkyl group having 3 to 18, preferably 3 to 10 carbon atoms, such as zinc dipropyldithiophosphate, zinc dibutyldithiophosphate, zinc dipentyldithiophosphate, zinc dihexyldithiophosphate, zinc diheptyldithiophosphate, and zinc dioctyldithiophosphate; zinc di((alkyl) aryl)dithiophosphates having an aryl or alkylaryl group having 6 to 18, preferably 6 to 10 carbon atoms such as zinc diphenyldithiophosphate and zinc ditolyldithiophosphate; and mixtures thereof.

In the case where the lubricating oil composition of the present invention contains a phosphorus compound selected from Components (A) as the main component, it is extremely excellent in long-drain properties such as oxidation stability and base number retention properties and high temperature detergency and can exhibit an excellent friction reducing effect even without the use of Component (B). Therefore, in the case where the composition contains a phosphorus compound selected from Components (A) as the main component, i.e., fulfils any one of the above-described requirements (I) to (III), the composition contains Component (B) in an amount of 0.05 percent by mass or less, preferably 0.03 percent by mass or less, more preferably 0.01 percent by mass or less, in terms of phosphorus based on the total mass of the composition and most preferably contains no Component (B), with the objective of maintaining these excellent properties.

In the case where the lubricating oil composition contains a phosphorus compound selected from Components (B), i.e., zinc dithiophosphates as the main component or a single phosphorus component, i.e., fulfils the requirement (IV), the composition contains Component (B) in an amount of 0.05 percent by mass or less in terms of phosphorus based on the total mass of the composition thereby obtaining an enhanced friction reducing effect which is though somewhat less than the composition containing a phosphorus compound selected from Components (A) as the main component. The content of Component (B) is preferably from 0.01 to 0.05 percent by mass. Component (B) in excess of 0.08 percent in terms of phosphorus by mass based on the total mass of the composition fails to exhibit sufficient effects. When the lubricating oil composition of the present invention fulfills the requirement (IV), it may contain Component (A).

Components (C) of the lubricating oil composition of the present invention are metallic detergents such as alkali metal or alkaline earth metal sulfonates, alkali metal or alkaline earth metal phenates, alkali metal or alkaline earth metal salicylates, alkali metal or alkaline earth metal phosphonates, and mixtures thereof.

Preferred alkali metal or alkaline earth metal sulfonates are alkali or alkaline earth metal salts such as magnesium and/or calcium salts, of alkyl aromatic sulfonic acids obtained by sulfonating alkyl aromatic compounds having a molecular weight of 100 to 1,500 and preferably 200 to 700. Specific examples of alkyl aromatic sulfonic acids include petroleum sulfonic acids and synthetic sulfonic acids.

Petroleum sulfonic acids may be those obtained by sulfonating alkyl aromatic compounds contained in the lubricant fraction of a mineral oil or mahogany acid by-produced upon production of white oil. The synthetic sulfonic acid may be those obtained by sulfonating an alkyl benzene having a straight-chain or branched alkyl group, produced as a by-product from a plant for producing an alkyl benzene used as the raw materials of detergents or obtained by alkylating polyolefin to benzene, or those obtained by sulfonating an dinonylnaphthalene. Although not restricted, sulfonating agents used for sulfonating these alkyl aromatic compounds may be fuming sulfuric acids and sulfuric acid.

Preferred alkali metal or alkaline earth metal phenates are those such as magnesium salts and/or calcium salts, of an alkylphenol having at least one straight-chain or branched alkyl group having 4 to 30, preferably 6 to 18 carbon atoms, an alkylphenolsulfide obtained by reacting such an alkylphenol with sulfur, or a Mannich reaction product of an alkylphenol obtained by reacting an alkylphenol with formaldehyde.

Preferred alkali metal or alkaline earth metal salicylates are those such as magnesium salts and/or calcium salts of an alkyl salicylic acid having at least one straight-chain or branched alkyl group having 4 to 30, preferably 6 to 18 carbon atoms.

The alkali metal or alkaline earth metal sulfonates, alkali metal or alkaline earth metal phenates, and alkali metal or alkaline earth metal salicylates include neutral salts(normal salts) obtained by reacting alkyl aromatic sulfonic acids, alkylphenols, alkylphenolsulfides, alkylsalicylic acids, or Mannich reaction products of alkylphenols directly with a metallic base of an alkali metal or alkaline earth metal oxide or hydroxide or obtained by converting alkyl aromatic sulfonic acids, alkylphenols, alkylphenolsulfides, alkylsalicylic acids, or Mannich reaction products of alkylphenols to alkali metal salts such as sodium salts and potassium salts, followed by substitution with an alkaline earth metal salt; basic salts obtained by heating these neutral salts with an excess amount of an alkali metal or alkaline earth metal salt or an alkali metal or alkaline earth metal base (alkali metal or alkaline earth metal hydroxide or oxide) in the presence of water; and overbased salts (superbasic salts) obtained by reacting these neutral salts with a base of an alkali metal or alkaline earth metal hydroxide in the presence of carbonic acid gas, boric acid or borate.

These reactions are generally carried out in a solvent (aliphatic hydrocarbon solvents such as hexane, aromatic hydrocarbon solvents such as xylene, and light lubricating base oil). Although metallic detergents are usually commercially available in the form of diluted with a light lubricating base oil, it is preferred to use metallic detergents whose metal content is within the range of 1.0 to 20 percent by mass and preferably 2.0 to 16 percent by mass.

In the present invention, Component (C) may be one or more of alkali metal or alkaline earth metal sulfonates, phenates, and salicylates having a base number of 0 to 500 mgKOH/g and preferably 20 to 450 mgKOH/g. The term "base number" used herein denotes a base number measured by the perchloric acid potentiometric titration method in accordance with section 7 of JIS K2501 "Petroleum products and lubricants-Determination of neutralization number".

No particular limitation is imposed on the metal ratio of Component (C). Generally, those with a metal ratio of 20 or less are used. However, with the objective of further improving a friction reducing effect and long-drain properties, Component (C) is composed of a metallic detergent with a metal ratio of preferably 2.3 or less, more preferably 1.5 or less, and further more preferably 1.3 or less. In this case, as long as the metal ratio is 2.3 or less, one or more of the above-described various metallic detergents may be used in the form of a mixture. The term "metal ratio" used herein is represented by "valence of metal element×metal element content (mol %)/soap group content (mol %) in a metallic detergent" wherein the metal element is calcium, magnesium, or the like and the soap group is a sulfonic acid group, a salicylic acid group, or the like.

Particularly preferred for Component (C) are alkali metal salicylates and alkaline earth metal salicylates because they have a large friction reducing effect due to their less ash content and more excellent long-drain properties.

When the lubricating oil composition of the present invention contains Component (C), no particular limitation is imposed on the upper limit content thereof as long as the sulfated ash content of the composition is 0.8 percent by mass or less. The content of Component (C) is adjustable with the contents of other metal-containing additives. The upper limit content is preferably 0.15 percent by mass, more preferably 0.11 percent by mass, and particularly preferably 0.10 percent by mass in terms of metal based on the total mass of the composition, while the lower limit is usually 0.01 percent by mass, preferably 0.02 percent by mass and particularly preferably 0.05 percent by mass. Component (C) of less than 0.01 percent by mass is not preferred because it is hard to obtain high temperature detergency and long-drain properties such as oxidation stability and base number retention properties.

Component (D), i.e., ashless dispersant of the lubricating oil composition of the present invention may be any of those used in lubricating oils, such as nitrogen-containing compounds having at least one straight-chain or branched alkyl or alkenyl group having 40 to 400 carbon atoms in the molecules and derivatives thereof, and modified products of alkenyl succinimides. Any one or more of these compounds may be blended.

The carbon number of the alkyl or alkenyl group is preferably 40 to 400 and preferably 60 to 350. An alkyl or alkenyl group having fewer than 40 carbon atoms would deteriorate the solubility of the compound in a lubricating base oil, while an alkyl or alkenyl group having more than 400 carbon atoms would deteriorate the low-temperature fluidity of the resulting lubricating oil composition. The alkyl or alkenyl group may be straight-chain or branched but is preferably a branched alkyl or alkenyl group derived from an oligomer of an olefin such as propylene, 1-butene, and isobutylene or from a cooligomer of ethylene and propylene.

Specific examples of Component (D) include the following compounds one or more of which may be used:

(D-1) succinimides having in their molecules at least one alkyl or alkenyl group having 40 to 400 carbon atoms and derivatives thereof;

(D-2) benzylamines having in their molecules at least one alkyl or alkenyl group having 40 to 400 carbon atoms and derivatives thereof; and (D-3) polyamines having in their molecules at least one alkyl or alkenyl group having 40 to 400 carbon atoms and derivatives thereof.

Specific examples of (D-1) succinimides include compounds represented by formulas (3) and (4):

(3)

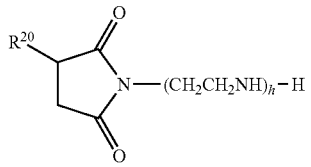

wherein $R^{20}$ is an alkyl or alkenyl group having 40 to 400 and preferably 60 to 350, and h is an integer from 1 to 5, preferably 2 to 4; and (4)

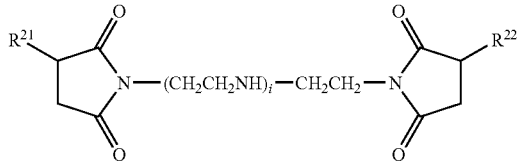

wherein $R^{21}$ and $R^{22}$ are each independently an alkyl or alkenyl group having 40 to 400, preferably 60 to 350 carbon atoms, and particularly preferably a polybutenyl group, and i is an integer from 0 to 4, preferably 1 to 3.

Succinimides include mono-type succinimides wherein a succinic anhydride is added to one end of a polyamine as represented by formula (3) and bis-type succinimides wherein a succinic anhydride is added to both ends of a polyamine as represented by formula, (4). The lubricating oil composition may contain either type of the succinimides or mixtures thereof.

No particular limitation is imposed on the method of producing these succinimides. For example, there may be used a method wherein an alkyl or alkenyl succinimide obtained by reacting a compound having an alkyl or alkenyl group having 40 to 400 carbon atoms with maleic anhydride at a temperature of 100 to 200° C. is reacted with a polyamine such as diethylene triamine, triethylene tetramine, tetraethylene pentamine or pentaethylene hexamine.

Specific examples of (D-2) benzylamines include compounds represented by formula (5):

(5)

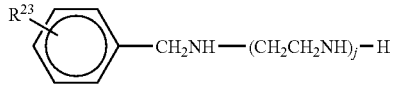

wherein $R^{23}$ is an alkyl or alkenyl group having 40 to 400 and preferably 60 to 350 carbon atoms, and j is an integer from 1 to 5, preferably 2 to 4.

Although no particular limitation is imposed on the method for producing the benzylamines, they may be obtained by reacting a polyolefin such as a propylene oligomer, polybutene, or ethylene-α-olefin copolymer with a phenol so as to obtain an alkylphenol and then subjecting the alkylphenol to Mannich reaction with formaldehyde and a polyamine such as diethylenetriamine, triethylenetetramine, tetraethylenepentamine, or pentaethylenehexamine.

Specific examples of (D-3) polyamines include compounds represented by formula (6):

$$R^{24}—NH—(CH_2CH_2NH)_k—H \quad (6)$$

wherein $R^{24}$ is an alkyl or alkenyl group having 40 to 400 and preferably 60 to 350, and k is an integer from 1 to 5 and preferably 2 to 4.

No particular limitation is imposed on the method for producing the polyamines. For example, the polyamines may be produced by chlorinating a polyolefin such as a propylene oligomer, polybutene, or ethylene-α-olefin copolymer and reacting the chlorinated polyolefin with ammonia or a polyamine such as ethylenediamine, diethylenetriamine, triethylenetetramine, tetraethylenepentamine, or pentaethylenehexamine.

Specific examples of the derivatives of the nitrogen-containing compounds exemplified as an example of Component (D) include acid-modified compounds obtained by allowing any of the above-described nitrogen-containing compounds to react with a monocarboxylic acid having 1 to 30 carbon atoms, such as fatty acid or a polycarboxylic acid having 2 to 30 carbon atoms, such as oxalic acid, phthalic acid, trimellitic acid, and pyromellitic acid so as to neutralize or amidize the part or whole of the remaining amino and/or imino groups; boron-modified compounds obtained by allowing any of the above-described nitrogen-containing compounds to react with boric acid so as to neutralize or amidize the part or whole of the remaining amino and/or imino groups; sulfur-modified compounds obtained by allowing any of the above-described nitrogen-containing compounds to react with a sulfuric compound; and modified products obtained by a combination of 2 or more selected from the acid modification, boron modification, and sulfur modification, of the above-described nitrogen-containing compounds. Among these derivatives, boric acid-modified compounds of alkenyl succinimides are effective because they are excellent in heat resistance and anti-oxidation properties and can enhance the base number retention properties and high temperature detergency of the resulting lubricating oil composition.

When the lubricating oil composition of the present invention contains Component (D), the content thereof is from 0.01 to 20 percent by mass and preferably 0.1 to 10 percent by mass based on the total mass of the composition. Component (D) of less than 0.01 percent by mass is no effective in high temperature detergency, while Component (D) of more than 20 percent by mass deteriorate extremely the low temperature fluidity.

Component (E), i.e., anti-oxidants may be any of phenol-based anti-oxidants, amine-based anti-oxidants, and metal-based anti-oxidants as long as they are generally used in lubricating oils. Addition of an anti-oxidant can enhance the anti-oxidation properties of a lubricating oil composition and thus can enhance the base number retention properties and high temperature detergency thereof.

Examples of the phenol-based anti-oxidants include 4,4'-methylenebis(2,6-di-tert-butylphenol), 4,4'-bis(2,6-di-tert-butylphenol), 4,4'-bis(2-methyl-6-tert-butylphenol), 2,2'-methylenebis(4-ethyl-6-tert-butylphenol), 2,2'-methylenebis(4-methyl-6-tert-butylphenol), 4,4'-butylidenebis(3-methyl-6-tert-butylphenol), 4,4'-isopropylidenebis(2,6-di-tert-butylphenol), 2,2'-methylenebis(4-methyl-6-nonylphenol), 2,2'-isobutylidenebis(4,6-dimethylphenol), 2,2'-methylenebis(4-methyl-6-cyclohexylphenol), 2,6-di-tert-butyl-4-methylphenol, 2,6-di-tert-butyl-4-ethylphenol, 2,4-dimethyl-6-tert-butylphenol, 2,6-di-tert-α-dimethylamino-p-cresol, 2,6-di-tert-butyl-4(N,N'- dimethylaminomethylphenol), 4,4'-thiobis(2-methyl-6-tert-butylphenol), 4,4'-thiobis(3-methyl-6-tert-butylphenol), 2,2'-thiobis(4-methyl-6-tert-butylphenol), bis(3-methyl-4-hydroxy-5-tert-butylbenzyl)sulfide, bis(3,5-di-tert-butyl-4-hydroxybenzyl)sulfide, 2,2'-thio-diethylenebis[3-(3,5-di-tert-butyl-4-hydroxyphenyl)propionate], tridecyl-3-(3,5-di-tert-butyl-4-hydroxyphenyl) propionate, pentaerythrityl-tetraquis[3-(3,5-di-tert-butyl-4-hydroxyphenyl)propionate], octyl-3-(3,5-di-tert-butyl-4-hydroxyphenyl) propionate, octadecyl-3-(3,5-di-tert-butyl-4-hydroxyphenyl) propionate, and 3-methyl-5-tert-butyl-4-hydroxyphenyl-substituted fatty acid esters. Mixtures of two or more of these compounds may be used.

Examples of the amine-based anti-oxidants include phenyl-α-naphtylamines, alkylphenyl-α-naphtylamines, and dialkyldiphenylamine. Two or more of these may be mixed.

The phenol-based anti-oxidant and amine-based anti-oxidant may be used in combination.

When the lubricating oil composition of the present invention contains Component (E), the content thereof is 5 percent by mass or less, preferably 3 percent by mass or less, and more preferably 2.5 percent by mass or less based on the total mass of the composition. Component (E) of more than 5 percent by mass fails to obtain sufficient anti-oxidation properties as balanced with the content. The content of Component (E) is preferably 0.1 percent by mass or more and preferably 1 percent by mass or more in order to further enhance the base number retention properties and high temperature detergency during the process of deterioration of the lubricating oil.

The lubricating oil composition of the present invention comprises a base oil and at least one type of phosphorus compound selected from the group consisting of the above-described Components (A) and (B) and at least one additive selected from the group consisting of the above-described Components (C) to (E) and fulfills one requirement selected from the following requirements (I) to (IV):

(I) the composition contains a phosphorus compound selected from Components (A) as the main component and sulfated ash in an amount of 0.8 percent by mass or less;

(II) the composition contains a phosphorus compound selected from Components (A) as the main component, (F) a sulfur-containing organic molybdenum complex in an amount of 0.001 to 0.2 percent by mass in terms of molybdenum based on the total mass of the composition, and sulfated ash in amount of 1.2 percent by mass or less;

(III) the composition contains a phosphorus compound selected from Components (A) as the main component, (G) an ashless friction modifier, and sulfated ash in an amount of 1.2 percent by mass or less; and (IV) the composition contains a phosphorus compound selected from Components (B) in an amount of 0.05 percent by mass or less in terms of phosphorus based on the total mass of the composition, as the main component, (G) an ashless friction modifier, and sulfated ash in an amount of 1.2 percent by mass or less.

Requirement (I) stipulates that when the lubricating oil composition contains a phosphorus compound selected from Components (A) as the main component, the sulfated ash content of the composition is 0.8 percent by mass or less. The sulfated ash content of the composition is preferably 0.6 percent by mass or less, more preferably 0.5 percent by mass or less, and further more preferably 0.4 percent by mass or less. The sulfated ash content is a value measured by a method described by "Testing Methods for Sulfated Ash" stipulated in JIS K 2272 5. and mainly results from metal-containing additives.

Examples of Component (F), i.e., sulfur-containing organic molybdenum complex in Requirement (II) include molybdenum dithiophosphates, molybdenum dithiocarbamates, and organic molybdenum complex containing in the molecules sulfur.

Specific examples of molybdenum dithiophosphates include compounds represented by formula (6):

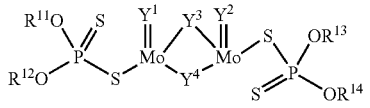

(6)

wherein $R^{11}$, $R^{12}$, $R^{13}$, and $R^{14}$ may be the same or different from each other and a hydrocarbon group such as alkyl groups having 2 to 30, preferably 5 to 18, and more preferably 5 to 12 carbon atoms and (alkyl)aryl group having 6 to 18 and preferably 10 to 15 carbon atoms, and $Y^1$, $Y^2$, $Y^3$, and $Y^4$ are each independently sulfur or oxygen.

Preferred examples of the alkyl group include ethyl, propyl, butyl, pentyl, hexyl, heptyl, octyl, nonyl, decyl, undecyl, dodecyl, tridecyl, tetradecyl, pentadecyl, hexadecyl, heptadecyl, and octadecyl groups, all of which may be primary, secondary, or tertiary alkyl groups and straight-chain or branched.

Preferred examples of the (alkyl)aryl groups include phenyl, tolyl, ethylphenyl, propylphenyl, butylphenyl, pentylphenyl, hexylphenyl, octylphenyl, nonylphenyl, decylphenyl, undecylphenyl, and dodecylphenyl groups, all of which alkyl groups may be primary, secondary or tertiary alkyl groups and straight-chain or branched. Furthermore, the (alkyl)aryl groups include all positional isomers wherein the aryl group may possess an alkyl substituent at any position.

Specific examples of molybdenum dithiophophates include sulfurizedmolybdenum diethyldithiophosphate, sulfurized molybdenum dipropyldithiophosphate, sulfurized molybdenum dibutyldithiophosphate, sulfurized molybdenum dipentyldithiophosphate, sulfurized molybdenum dihexyldithiophosphate, sulfurized molybdenum dioctyldithiophosphate, sulfurized molybdenum didecyldithiophosphate, sulfurized molybdenum didodecyldithiophosphate, sulfurized molybdenum di(butylphenyl) dithiophosphate, sulfurized molybdenum di(nonylphenyl) dithiophosphate, sulfurized oxymolybdenum diethyldithiophosphate, sulfurized oxymolybdenum dipropyldithiophosphate, sulfurized oxymolybdenum dibutyldithiophosphate, sulfurized oxymolybdenum dipentyldithiophosphate, sulfurized oxymolybdenum dihexyldithiophosphate, sulfurized oxymolybdenum dioctyldithiophosphate, sulfurized oxymolybdenum didecyldithiophosphate, sulfurized oxymolybdenum didodecyldithiophosphate, sulfurized oxymolybdenum di(butylphenyl)dithiophosphate, sulfurized oxymolybdenum di(nonylphenyl) dithiophosphate, all of which the alkyl groups may be straight-chain or branched and the alkyl groups may bond to any position of the alkylphenyl groups, and mixtures thereof. Furthermore, the molybdenum dithiophosphate may be those having in one molecule hydrocarbon groups each having a different carbon number and/or structure from each other.

Specific examples of molybdenum dithiocarbamates include compounds represented by formula (7):

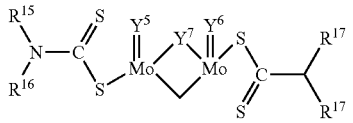

(7)

wherein $R^{15}$, $R^{16}$, $R^{17}$ and $R^{18}$ may be the same or different from each other and a hydrocarbon group such as alkyl groups having 2 to 24 and preferably 4 to 13 and (alkyl)aryl group having 6 to 24 and preferably 10 to 15 carbon atoms, and $Y^5$, $Y^6$, $Y^7$, and $Y^8$ are each independently sulfur or oxygen.

Preferred examples of the alkyl group include ethyl, propyl, butyl, pentyl, hexyl, heptyl, octyl, nonyl, decyl, undecyl, dodecyl, tridecyl, tetradecyl, pentadecyl, hexadecyl, heptadecyl, and octadecyl groups, all of which may be primary, secondary, or tertiary alkyl groups and straight-chain or branched.

Preferred examples of the (alkyl)aryl groups include phenyl, tolyl, ethylphenyl, propylphenyl, butylphenyl, pentylphenyl, hexylphenyl, octylphenyl, nonylphenyl, decylphenyl, undecylphenyl, and dodecylphenyl groups, all of which alkyl groups may be primary, secondary or tertiary alkyl groups and straight-chain or branched. Furthermore, the (alkyl)aryl groups include all positional isomers wherein the aryl group may possess an alkyl substituent at any position. Examples other than the molybdenum dithiocarbamates with the structure described above include those having a structure that a thio- or polythio-trinuclear molybdenum comprises bonded thereto ligands such as dithiocarbamates, as disclosed in WO98/26030 and WO99/31113.

Specific examples of the molybdenum dithiocarbamates include sulfurized molybdenum diethyldithiocarbamate, sulfurized molybdenum dipropyldithiocarbamate, sulfurized molybdenum dibutyldithiocarbamate, sulfurized molybdenum dipentyldithiocarbamate, sulfurized molybdenum dihexyldithiocarbamate, sulfurized molybdenum dioctyldithiocarbamate, sulfurized molybdenum didecyldithiocarbamate, sulfurized molybdenum didodecyldithiocarbamate, sulfurized molybdenum di(butylphenyl) dithiocarbamate, sulfurized molybdenum di(nonylphenyl) dithiocarbamate, sulfurized oxymolybdenum diethyldithiocarbamate, sulfurized oxymolybdenum dipropyldithiocarbamate, sulfurized oxymolybdenum dibutyldithiocarbamate, sulfurized oxymolybdenum dipentyldithiocarbamate, sulfurized oxymolybdenum dihexyldithiocarbamate, sulfurized oxymolybdenum dioctyldithiocarbamate, sulfurized oxymolybdenum didecyldithiocarbamate, sulfurized oxymolybdenum didodecyldithiocarbamate, sulfurized oxymolybdenum di(butylphenyl)dithiocarbamate, sulfurized oxymolybdenum di(nonylphenyl)dithiocarbamate, all of which the alkyl groups may be straight-chain or branched and the alkyl groups may bond to any position of the alkylphenyl groups, and mixtures thereof. Furthermore, the molybdenum dithiocarbamate may be those having in one molecule hydrocarbon groups each having a different carbon number and/or structure from each other.

Examples other than these sulfur-containing organic molybdenum complexes include complexes of molybdenum compounds (for example, molybdenum oxides such as molybdenum dioxide and molybdenum trioxide, molybdic acids such as orthomolybdic acid, paramolybdic acid, and sulfurized (poly)molybdic acid, metal salts of these molybdic acids, molybdates such as ammonium molybdate, molybdenum sulfides such as molybdenum disulfide, molybdenum trisulfide, molybdenum pentasulfide, and molybdenum polysulfide, sulfurized molybdenum acid, metal and amine salts of sulfurized molybdenum acid, and halogenated molybdenum such as molybdenum chloride) and sulfur-containing organic compounds (for example, alkyl(thio)xanthate, thiaziazole, mercaptothiadiazole, thiocarbonate, tetrahydrocarbylthiramdisulfide, bis(di(thio) hydrocarbyldithiophosphonate)disulfide, organic (poly) sulfide, and sulfurized esters) or other organic compounds.

Other preferred examples for Component (F) may be mixtures of one or more molybdenum dithiophosphates and one or more molybdenum dithiocarbamates, selected from the above-exemplified compounds or those of one or more molybdenum dithiophosphates and one or more molybdenum dithiocarbamates, selected from the above-exemplified compounds and other sulfur-containing molybdenum complexes, mixed at an arbitrary ratio.

In Requirement (II), the content of Component (F) is from 0.001 to 0.2 percent by mass, preferably 0.01 to 0.15 percent by mass, and particularly preferably 0.02 to 0.1 percent by mass in terms of molybdenum based on the total mass of the composition. Component (F) of more than 0.2 percent by mass would fail to exhibit a friction reducing effect as balanced with the content and increase ash and sulfur contents, possibly resulting in poor storage stability.

The sulfated ash content of the composition is 1.2 percent by mass or less, preferably 1.0 percent by mass or less, more preferably 0.8 percent by mass or less, further more preferably 0.6 percent by mass or less, and particularly preferably 0.5 percent by mass or less.

Component (G), i.e., ashless friction modifiers in Requirements (III) and (IV) may be any of compounds which are generally used as friction modifiers for lubricating oils. Examples of such compounds include fatty acid esters and amine compounds, having at least one hydrocarbon group having 6 to 30 carbon atoms, preferably alkyl or alkenyl group, and particularly preferably straight-chain alkyl or alkenyl group having 6 to 30 carbon atoms per molecule.

Specific examples of the straight-chain alkyl and alkenyl groups include alkyl groups such as hexyl, heptyl, octyl, nonyl, decyl, undecyl, dodecyl, tridecyl, tetradecyl, pentadecyl, hexadecyl, heptadecyl, octadecyl, nonadecyl, eicosyl, heneicosyl, docosyl, tricosyl, tetracosyl, pentacosyl, hexacosyl, heptacosyl, octacosyl, nonacosyl, and triacontyl, and alkenyl groups such as hexenyl, heptenyl, octenyl, noneyl, decenyl, undecenyl, dodecenyl, tridecenyl, tetradecenyl, pentadecenyl, hexadecenyl, heptadecenyl, octadecenyl, nonadecenyl, eicosenyl, heneicosenyl, docosenyl, tricosenyl, tetracosenyl, pentacosenyl, hexacosenyl, heptacosenyl, octacosenyl, nonacosenyl, and triacontenyl groups, the position of which the double bonds may vary.

Examples of the fatty acid esters include esters of straight-chain or branched, preferably straight-chain fatty acids having 7 to 31 carbon atoms and aliphatic monohydric alcohols or aliphatic polyhydric alcohols. Examples of the amine compounds include straight-chain or branched, preferably straight-chain aliphatic monoamines having 6 to 30 carbon atoms, straight-chain or branched, preferably straight-chain aliphatic polyamines having 6 to 30 carbon atoms, and alkyleneoxide adducts of these aliphatic amines. In the present invention, preferred are fatty acid esters of fatty acids having 12 to 20 carbon atoms and glycerin or sorbitan, among which more preferred are glycerin monoesters and sorbitan monoesters and particularly preferred is glycerin monoesters of oleic acid.

No particular limitation is imposed on the content of Component (G) in Requirements (III) and (IV). However, the content is preferably 0.1 percent by mass or more and more preferably 0.2 percent by mass or more. Furthermore, the content is preferably 1 percent by mass or less and more preferably 0.8 percent by mass or less. Component (G) of more than 1 percent by mass would cause poor storage stability of the resulting composition.

In Requirements (III) and (IV), the sulfated ash content of the composition is 1.2 percent by mass or less, preferably 1.0 percent by mass or less, more preferably 0.8 percent by mass or less, further more preferably 0.6 percent by mass or less, further more preferably 0.5 percent by mass, and particularly preferably 0.4 percent by mass.

In Requirement (IV), the composition contains a phosphorus compound selected from Components (B) as the main component or as a single phosphorus compound and Component (G). In this case, the content of Component (B) is 0.05 percent by mass or less, preferably from 0.01 to 0.05 percent by mass, and particularly preferably 0.04 to 0.05 percent by mass in terms of phosphorus based on the total mass of the composition.

In order to further enhance the performance characteristics of the lubricating oil composition of the present invention, it may be blended with any of additives which have been used in lubricating oils, depending on purposes. Examples of such additives include anti-wear agents other than Components (A) and (B), friction modifiers other than Component (G), viscosity index improvers, corrosion inhibitors, rust inhibitors, demulsifiers, metal passivators, anti-foaming agents, and dyes.

Examples of anti-wear agents other than Components (A) and (B) include sulfur-containing compounds such as disulfides, olefin sulfides, sulfurized fats and oils, zinc dithiocarbamate, dithiophosphates, and dithiocarbamate. The content of the anti-wear agent is preferably 0.1 percent by mass or less and more preferably 0.05 percent by mass or less, based on the total mass of the composition.

Examples of friction modifiers other than Components (G) include molybdenum-amine complexes, molybdenum-succinimide complexes, molybdenum disulfide, long-chain fatty acids, long-chain aliphatic alcohols, long-chain fatty acid esters, and fatty acid amides.

Examples of viscosity index improvers include non-dispersion type viscosity index improvers such as polymers or copolymers of one or more monomers selected from various methacrylates or hydrides thereof; dispersion type viscosity index improvers such as copolymers of various methacrylates further containing nitrogen compounds; non-dispersion- or dispersion-type ethylene-α-olefin copolymers of which the α-olefin may be propylene, 1-butene, or 1-pentene, or the hydrides thereof; polyisobutylenes or the hydrides thereof; styrene-diene hydrogenated copolymers; styrene-maleic anhydride ester copolymers; and polyalkylstyrenes.

It is necessary to select the molecular weight of these viscosity index improvers considering the shear stability thereof. Specifically, the number-average molecular weight of non-dispersion or dispersion type polymethacrylates is from 5,000 to 1,000,000 and preferably from 100,000 to 900,000. The number-average molecular weight of polyisobutylenes or hydrides thereof is from 800 to 5,000 and preferably from 1,000 to 4,000. The number-average molecular weight of ethylene-α-olefin copolymers or hydrides thereof is from 800 to 500,000 and preferably from 3,000 to 200,000.

Among these viscosity index improvers, the use of ethylene-α-olefin copolymers or hydrides thereof is contributive to the production of a lubricating oil composition which is particularly excellent in shear stability. One or more compounds selected from the above-described viscosity index improvers may be blended in an arbitrary amount. The content of the viscosity index improver is generally from 0.1 to 20 percent by mass, based on the total mass of the composition.

Examples of corrosion inhibitors include benzotriazole-, tolyltriazole-, thiadiazole-, and imidazole-based compounds.

Examples of rust inhibitors include petroleum sulfonates, alkylbenzene sulfonates, dinonylnaphthalene sulfonates, alkenyl succinic acid esters, and polyhydric alcohol esters.

Examples of demulsifiers include polyalkylene glycol-based non-ionic surfactants such as polyoxyethylenealkyl ethers, polyoxyethylenealkylphenyl ethers, and polyoxyethylenealkylnaphthyl ethers.

Examples of metal passivators include imidazolines, pyrimidine derivatives, alkylthiadiazoles, mercaptobenzothiazoles, benzotriazoles and derivatives thereof, 1,3,4-thiadiazolepolysulfide, 1,3,4-thiadiazolyl-2,5-bisdialkyldithiocarbamate, 2-(alkyldithio)benzoimidazole, and β-(o-carboxybenzylthio)propionitrile.

Examples of anti-foaming agents include silicone, fluorosilicone, and fluoroalkyl ethers.

When these additives are blended with the lubricating oil composition of the present invention, the content of each of the corrosion inhibitor, rust inhibitor, and demulsifier is selected from 0.005 to 5 percent by mass based on the total mass of the composition. The content of the metal passivator is selected from 0.005 to 1 percent by mass, while the content of the anti-foaming agent is selected from 0.0005 to 1 percent by mass.

The lubricating oil composition of the present invention can be rendered a low sulfur content lubricating oil composition with excellent low friction characteristics, whose sulfur content is 0.5 percent by mass or less, preferably 0.3 percent by mass or less, more preferably 0.2 percent by mass or less, even more preferably 0.1 percent by mass or less, and further more preferably 0.05 percent by mass or less, by selecting properly a lubricating base oil, each component, and various additives. The present invention can also provide a lubricating oil composition with a sulfur content of 0.01 percent by mass or even 0.005 percent by mass or less or with substantially no sulfur.

The lubricating oil composition of the present invention is excellent not only in friction reducing effect but also in anti-wear effect, long-drain properties, i.e., oxidation stability and base number retention properties, and high temperature detergency and can be used preferably for internal combustion engines such as gasoline engines, diesel engines, and gas engines, of motorcycles, automobiles, power generators, and ships and also for internal combustion engines equipped with an exhaust-gas after-treatment device because of its low ash, sulfur, and phosphorus contents. Furthermore, the lubricating oil composition can exhibit a friction reducing effect in an engine whose valve train system is direct striking bucket type or roller follower-type, particularly roller follower-type. The lubricating oil composition can be used suitably for internal combustion engines using gasoline, gas oil, or kerosene, whose sulfur content is 50 ppm by mass or less, preferably 30 ppm by mass or less, and particularly preferably 10 ppm by mass or less or fuels whose sulfur content is 1 ppm by mass or less, such as LPG, natural gas, substantially sulfur-free hydrogen, dimethylether, alcohols, and GTL (Gas to Liquid) fuel and particularly for gas engines.

Furthermore, the lubricating oil composition can be used suitably as lubricants required to have any of the above-described characteristic performances, such as those for driving systems of automatic or manual transmissions, grease, wet brake oils, hydraulic oils, turbine oils, compressor oils, bearing oils, refrigerating oils, or the like.

BEST MODES FOR CARRYING OUT THE INVENTION

Hereinafter, the present invention will be described in more details by way of the following examples and comparative examples, which should not be construed as limiting the scope of the invention.

EXAMPLES 1 AND 2, COMPARATIVE EXAMPLE 1, AND REFERENCE EXAMPLE 1

Lubricating oil compositions of the present invention (Examples 1 and 2) and those for comparison (Reference Example 1 and Comparative Example 1) were prepared in accordance with the formulations shown in Table 1.

The following performance evaluation tests were conducted for the resulting compositions.

(1) Whole Engine Motoring Friction Test

A whole engine motoring friction test was conducted for the lubricating oil compositions shown in Table 1 under the following conditions so as to measure the torque reduction rate (%) against the lubricating oil composition of Comparative Example 1 used as the reference oil. The results are shown in Table 1.

| | |
|---|---|
| Engine valve train system: | DOHC, direct striking bucket type valve train system |
| Oil temperature: | 80° C., 95° C. |
| Engine revolution: | 750 to 1,500 rpm |

(2) Valve Train Friction Test

A valve train friction test was conducted for the lubricating oil compositions shown in Table 1 under the following conditions so as to measure the torque reduction rate (%) against the reference oil (Comparative Example 1). The results are shown in Table 1.

| | |
|---|---|
| Engine valve train system: | OHC, roller follower type valve train system |
| Oil temperature: | 80° C. |
| Engine revolution: | 375 to 1,000 rpm |

TABLE 1

| | | Example 1 | Example 2 | Comparative Example 1 | Reference Example 1 |
|---|---|---|---|---|---|
| Lubricating base oil[1)] | mass % | balance | balance | balance | balance |
| (A) Phosphorus compound[2)] | mass % | 0.39 | — | — | 0.39 |
| Amount in terms of phosphorus | mass % | (0.05) | — | — | (0.05) |
| (A) Phosphorus compound[3)] | mass % | — | 0.7 | — | — |
| Amount in terms of phosphorus | mass % | — | (0.05) | — | — |
| (B) Zinc dithiophophate[4)] | mass % | — | — | 0.69 | — |
| Amount in terms of phosphorus | mass % | — | — | (0.05) | — |
| (C) Metallic detergent-1[5)] | mass % | 2 | 2 | 2 | — |
| (C) Metallic detergent-2[6)] | mass % | — | — | — | 6.25 |
| Amount in terms of metal | mass % | (0.08) | (0.08) | (0.08) | (0.25) |
| (D) Ashless dispersant[7)] | mass % | 5 | 5 | 5 | 5 |
| (E) Anti-oxidant[8)] | mass % | 2 | 2 | 2 | 2 |
| Viscosity index improver[9)] | mass % | 4 | 4 | 4 | 4 |
| Demulsifier[10)] | mass % | 0.01 | 0.01 | 0.01 | 0.01 |
| Total sulfur content | mass % | 0.01 | 0.01 | 0.11 | 0.01 |
| Sulfated ash content | mass % | 0.35 | 0.27 | 0.36 | 0.93 |
| Torque reduction rate (Whole engine friction test) | | | | | |
| 80° C. 750 rpm | % | 7 | 8 | standard | 3 |
| 80° C. 1,000 rpm | % | 4 | 5 | standard | 2 |
| 80° C. 1,500 rpm | % | 1 | 3 | standard | 0 |
| 95° C. 750 rpm | % | 15 | 16 | standard | 8 |
| 95° C. 1,000 rpm | % | 9 | 12 | standard | 3 |
| 95° C. 1,500 rpm | % | 3 | 3 | standard | 1 |
| Torque reduction rate (Valve train friction test) | | | | | |
| 80° C. 375 rpm | % | 27 | 35 | standard | 18 |
| 80° C. 500 rpm | % | 29 | 34 | standard | 19 |

TABLE 1-continued

| | | Example 1 | Example 2 | Comparative Example 1 | Reference Example 1 |
|---|---|---|---|---|---|
| 80° C. 750 rpm | % | 29 | 32 | standard | 18 |
| 80° C. 1,000 rpm | % | 27 | 32 | standard | 20 |

1)hydro-refined mineral oil, total aromatic content: 1.2 mass %, sulfur content: 0.001 mass %, 100° C. kinematic viscosity: 5.6 $mm^2/s$, viscosity index: 125, NOACK eveporation loss: 8 mass %
2)zinc di(n-butyl)phosphate, phosphorus content: 13.2 mass %, sulfur content: 0 mass %, zinc content: 13.0 mass %, sulfated ash content: 19.5 mass %
3)tri(2ethylhexyl)phosphate, phosphorus content: 7.1 mass %, sulfur content: 0 mass %
4)alkyl group: secbutyl/sechexyl, phosphorus content: 7.2 mass %, sulfur content: 15.2 mass %, zinc content: 7.8 mass %, sulfated ash content: 11.7 mass %
5)calcium salicylate-based detergent, base number: 120 mgKOH/g, metal ratio: 1.0, Ca content: 4.0 mass %, sulfated ash content: 13.6 mass %
6)calcium salicylate-based detergent, base number: 120 mgKOH/g, metal ratio: 2.7, Ca content: 4.0 mass %, sulfated ash content: 13.6 mass %
7)polybutenyl succinimide, number-average molecular weight of polybutenyl group: 1,300
8)octyl-3-(3,5-di-tert-butyl-4-hydroxyphenyl)propionate and alkyldiphenylamine (1:1)
9)OCP, weight average molecular weight: 150,000
10)polyalkylene glycol-based As apparent from the results shown in Table 1, in the engines equipped with a direct striking bucket type valve train system or roller follower type valve train system, the lubricating oil compositions of the present invention (Examples 1 and 2) exhibited a significantly excellent friction reducing effect, compared with the composition containing zinc dithiophosphate (Comparative Example 1) and still exhibited a more excellent friction reducing effect than the composition whose sulfated ash content is more than 0.8 percent by mass (Reference Example 1). It is recognized that particularly the composition containing phosphoric acid triesters (Example 2) can be lowered in ash content and exhibited a remarkable friction reducing effect.

It was also confirmed that the composition of Example 1 containing metallic detergent-1 whose metal ratio is 2.3 or lower exhibited a more excellent friction reducing effect than the composition of Reference Example 1 wherein the amount of metallic detergent-2 (metal ratio: 2.7) was decreased, and had no trouble with the anti-friction performance of the valve train system. A composition with a sulfated ash content exceeding 0.8 percent by mass, as resulting from the increase of the amount of metallic detergent-1 of the composition of Example 1 is deteriorated in friction reducing effect and poor in anti-wear properties. The lubricating oil composition of the present invention can exhibit a friction reducing effect when used in an engine equipped with a valve train system other than those of direct striking bucket type and roller follower type but is particularly preferably used in an engine equipped with such a direct striking bucket type or roller follower type valve train system because it can exhibit an excellent friction reducing effect particularly when used in such an engine.

EXAMPLES 3 TO 7 AND COMPARATIVE EXAMPLES 2 TO 4

Lubricating oil compositions of the present invention (Examples 3 to 7) and those for comparison (Comparative Examples 2 to 4) were prepared in accordance with the formulations shown in Tables 2 and 3.

The following performance evaluation tests were conducted for the resulting compositions.

(3) Whole Engine Motoring Friction Test

A whole engine motoring friction test was conducted for the lubricating oil compositions shown in Table 2 under the following conditions so as to measure the torque reduction rate (%) against the lubricating oil composition of Comparative Example 3 used as the reference oil. The results are shown in Table 2.

| | |
|---|---|
| Engine valve train system: | DOHC, direct striking bucket type valve train system |
| Oil temperature: | 80° C., 95° C. |
| Engine revolution: | 750 to 3,000 rpm |

(4) Valve Train Friction Test

A valve train friction test was conducted for the lubricating oil compositions shown in Table 3 under the following conditions so as to measure the torque reduction rate (%) against the reference oil (Comparative Example 4). The results are shown in Table 3.

| | |
|---|---|
| Engine valve train system: | OHC, roller follower type valve train system |
| Oil temperature: | 80° C. |
| Engine revolution: | 375 to 1,000 rpm |

TABLE 2

| | | Example 3 | Example 4 | Comparative Example 2 | Comparative Example 3 |
|---|---|---|---|---|---|
| Lubricating base oil1) | mass % | balance | balance | balance | balance |
| (A) Phosphorus compound2) | mass % | 0.7 | — | — | — |
| Amount in terms of phosphorus | mass % | (0.09) | — | — | — |
| (A) Phosphorus compound3) | mass % | — | 1.3 | — | — |
| Amount in terms of phosphorus | mass % | — | (0.09) | — | — |

TABLE 2-continued

| | | Example 3 | Example 4 | Comparative Example 2 | Comparative Example 3 |
|---|---|---|---|---|---|
| (B) Zinc dialkyldithiophophate[4)] | mass % | — | — | 1.3 | 1.3 |
| Amount in terms of phosphorus | mass % | — | — | (0.09) | (0.09) |
| (G) Ashless friction modifier[5)] | mass % | 0.5 | 0.5 | — | 0.5 |
| (C) Metallic detergent[6)] | mass % | 7.7 | 7.7 | 7.7 | 7.7 |
| Amount in terms of metal | mass % | (0.31) | (0.32) | (0.31) | (0.31) |
| Sulfated ash content | mass % | (1.05) | (1.05) | (1.05) | (1.05) |
| (D) Ashless dispersant[7)] | mass % | 5 | 5 | 5 | 5 |
| (E) Anti-oxidant[8)] | mass % | 2 | 2 | 2 | 2 |
| Viscosity index improver[9)] | mass % | 4 | 4 | 4 | 4 |
| Demulsifier[10)] | mass % | 0.01 | 0.01 | 0.01 | 0.01 |
| Total sulfur content (based on the total mass of the composition) | mass % | 0.01 | 0.01 | 0.21 | 0.21 |
| Sulfated ash content (based on the total mass of the composition) | mass % | 1.2 | 1.2 | 1.2 | 1.2 |
| Torque reduction rate (Whole engine motoring friction test) | | | | | |
| 80° C. 750 rpm | % | 10 | 11 | standard | 1 |
| 80° C. 1,000 rpm | % | 6 | 8 | standard | 2 |
| 80° C. 1,500 rpm | % | 1 | 3 | standard | −1 |
| 95° C. 750 rpm | % | 13 | 13 | standard | 0 |
| 95° C. 1,000 rpm | % | 10 | 10 | standard | 2 |
| 95° C. 1,500 rpm | % | 2 | 4 | standard | 0 |
| 95° C. 3,000 rpm | % | 1 | 3 | standard | 0 |

[1)]hydro-refined mineral oil, total aromatic content: 1.2 mass %; sulfur content: 10 mass ppm, 100° C. kinematic viscosity: 5.6 $mm^2/s$, viscosity index: 125, NOACK eveporation loss: 8 mass %

[2)]zinc di(n-butyl)phosphate, phosphorus content: 13.2 mass %, sulfur content: 0 mass %, zinc content: 13.0 mass %, sulfated ash content: 19.5 mass %

[3)]tri(2ethylhexyl)phosphate, phosphorus content: 7.1 mass %, sulfur content: 0 mass %

[4)]alkyl group: secbutyl/sechexyl, phosphorus content: 7.2 mass %, sulfur content: 15.2 mass %, zinc content: 7.8 mass %, sulfated ash content: 11.7 mass %

[5)]glycerin monoester of oleic acid

[6)]calcium salicylate-based detergent, base number: 120 mgKOH/g, Ca content: 4.0 mass %, metal ratio: 2.7, sulfated ash content: 13.6 mass %

[7)]polybutenyl succinimide, number-average molecular weight of polybutenyl group: 1,300

[8)]octyl-3-(3,5-di-tert-butyl-4-hydroxyphenyl)propionate and alkyldiphenylamine (1:1)

[9)]OCP, weight average molecular weight: 150,000

[10)]polyalkylene glycol-based

TABLE 3

| | | Example 5 | Example 6 | Example 7 | Comparative Example 4 |
|---|---|---|---|---|---|
| Lubricating base oil[1)] | mass % | balance | balance | balance | balance |
| (A) Phosphorus compound[2)] | mass % | 0.39 | — | — | — |
| Amount in terms of phosphorus | mass % | (0.05) | — | — | — |
| (A) Phosphorus compound[3)] | mass % | — | 0.7 | — | — |
| Amount in terms of phosphorus | mass % | — | (0.05) | — | — |
| (B) Zinc dialkyldithiophophate[4)] | mass % | — | — | 0.69 | 0.69 |
| Amount in terms of phosphorus | mass % | — | — | (0.05) | (0.05) |
| (G) Ashless friction modifier[5)] | mass % | 0.5 | 0.5 | 0.50 | — |
| (C) Metallic detergent[6)] | mass % | 2 | 2 | 2 | 2 |
| Amount in terms of metal | mass % | (0.08) | (0.08) | (0.08) | (0.08) |
| Sulfated ash content | mass % | (0.27) | (0.27) | (0.27) | (0.27) |
| (D) Ashless dispersant[7)] | mass % | 5 | 5 | 5 | 5 |
| (E) Anti-oxidant[8)] | mass % | 2 | 2 | 2 | 2 |
| Viscosity index improver[9)] | mass % | 4 | 4 | 4 | 4 |
| Demulsifier[10)] | mass % | 0.01 | 0.01 | 0.01 | 0.01 |
| Total sulfur content (based on the total mass of the composition) | mass % | 0.01 | 0.01 | 0.11 | 0.11 |
| Sulfated ash content (based on the total mass of the composition) | mass % | 0.35 | 0.27 | 0.36 | 0.36 |
| Torque reduction rate (Valve train friction test) | | | | | |
| 80° C. 375 rpm | % | 37 | 40 | 19 | standard |
| 80° C. 500 rpm | % | 39 | 43 | 19 | standard |

TABLE 3-continued

| | | Example 5 | Example 6 | Example 7 | Comparative Example 4 |
|---|---|---|---|---|---|
| 80° C. 750 rpm | % | 39 | 42 | 22 | standard |
| 80° C. 1,000 rpm | % | 35 | 37 | 22 | standard |

[1]hydro-refined mineral oil, total aromatic content: 1.2 mass %, sulfur content: 10 mass ppm, 100° C. kinematic viscosity: 5.6 $mm^2/s$, viscosity index: 125, NOACK eveporation loss: 8 mass %
[2]zinc di(n-butyl)phosphate, phosphorus content: 13.2 mass %, sulfur content: 0 mass %, zinc content: 13.0 mass %, sulfated ash content: 19.5 mass %
[3]tri(2ethylhexyl)phosphate, phosphorus content: 7.1 mass %, sulfur content: 0 mass %
[4]alkyl group: secbutyl/sechexyl, phosphorus content: 7.2 mass %, sulfur content: 15.2 mass %, zinc content: 7.8 mass %, sulfated ash content: 11.7 mass %
[5]glycerin monoester of oleic acid
[6]calcium salicylate-based detergent, base number: 120 mgKOH/g, Ca content: 4.0 mass %, metal ratio: 1.0, sulfated ash content: 13.6 mass %
[7]polybutenyl succinimide, number-average molecular weight of polybutenyl group: 1,300
[8]octyl-3-(3,5-di-tert-butyl-4-hydroxyphenyl)propionate and alkyldiphenylamine (1:1)
[9]OCP, weight average molecular weight 150,000
[10]polyalkylene glycol-based As apparent from the results shown in Table 2, in the engine equipped with a direct striking bucket type valve train system, the compositions containing Components (A) and (G) (Examples 3 and 4) exhibited a more excellent friction reducing effect than the composition containing Component (B) instead of Component (A) in the same amount as Examples 3 and 4 in terms of phosphorus but no Component (G) (Comparative Example 2). The composition of Comparative Example 3 containing Components (B) and (G) exhibits no friction reducing effect over that of Comparative Example 2. Therefore, as proved by Example 3, it is apparent that only the use of Components (A) and (G) in combination can exhibit an excellent friction reducing effect.

As apparent from the results shown in Table 3, it is recognized that the composition of the present invention containing Components (A) and (G) (Examples 5 and 6) and the composition containing Components (B) and (G) wherein the content of Component (B) is 0.05 percent by mass or less in terms of phosphorus (Example 7) exhibited an extremely more excellent friction reducing effect than the composition containing Component (B) in the same amount as Example 7 but no Component (G) (Comparative Example 4). Particularly, the compositions containing phosphoric acid triester (Examples 4 and 6) were excellent in friction reducing effect.

From the comparisons of Examples 5 and 6, and 3 and 4 or of Example 7 and Comparative Example 3, it was confirmed that an excellent friction reducing effect can be exhibited particularly with the cases where the sulfated ash content is 0.8 percent by mass or less, a metallic detergent with a metal ratio of 2.3 or less is used, and the content of Component (A) or (B) is decreased.

The lubricating oil composition of the present invention can exhibit a friction reducing effect when used in an engine equipped with a valve train system other than those of direct striking bucket type or roller follower type but is particularly preferably used in an engine equipped with a direct striking bucket type or roller follower type valve train system because it can exhibit excellent friction reducing effect particularly when used in such an engine.

EXAMPLES 8 TO 11, COMPARATIVE EXAMPLES 5 TO 7, AND REFERENCE EXAMPLES 2 AND 3

Lubricating oil compositions of the present invention (Examples 8 to 11) and those for comparison (Comparative Examples 5 to 7 and Reference Examples 1 and 2) were prepared in accordance with the formulations shown in Table 4.

A friction properties test was conducted for the resulting compositions under the conditions where a load was 400N, an oscillation frequency was 50 Hz, a stroke was 1.5 mm, and an oil temperature was 80° C., using a high-frequency, linear-oscillation SRV friction tester from Optimol Instruments. The results are shown in Table 4.

TABLE 4

| | | Example 8 | Example 9 | Example 10 | Example 11 | Comparative Example 5 | Comparative Example 6 | Reference Example 2 | Reference Example 3 | Comparative Example 7 |
|---|---|---|---|---|---|---|---|---|---|---|
| Lubricating base oil[1] | mass % | balance | balance | balance | balance | balance | balance | balance | balance | balance |
| (A) Phosphorus compound[2] | mass % | 0.39 | 0.39 | 0.39 | — | — | — | 0.39 | 0.39 | — |
| Amount in terms of phosphorus | mass % | (0.05) | (0.05) | (0.05) | — | — | — | (0.05) | (0.05) | — |
| (A) Phosphorus compound[3] | mass % | — | — | — | 0.7 | — | — | — | — | — |
| Amount in terms of phosphorus | mass % | — | — | — | (0.05) | — | — | — | — | — |
| (B) Zinc dialkyldithiophophate[4] | mass % | — | — | — | — | 0.69 | 0.69 | — | — | 0.69 |
| Amount in terms of phosphorus | mass % | — | — | — | — | (0.05) | (0.05) | — | — | (0.05) |
| (F) Sulfur-containing Mo complex-1[5] | mass % | 1.6 | — | 1.6 | 1.6 | 1.6 | — | — | — | 1.6 |
| (F) Sulfur-containing Mo complex-2[6] | mass % | — | 0.8 | — | — | — | 0.8 | — | — | — |
| Sulfur-free Mo complex-1[7] | mass % | — | — | — | — | — | — | 1.1 | — | — |
| Sulfur-free Mo complex-2[8] | mass % | — | — | — | — | — | — | — | 1.5 | — |
| Amount in terms of molybdenum | mass % | (0.07) | (0.07) | (0.07) | (0.07) | (0.07) | (0.07) | (0.07) | (0.07) | (0.07) |
| (C) Metallic detergent-1[9] | mass % | 2 | 2 | — | 2 | 2 | 2 | 2 | 2 | — |
| (C) Metallic detergent-2[10] | mass % | — | — | 2 | — | — | — | — | — | 2 |

TABLE 4-continued

| | | Example 8 | Example 9 | Example 10 | Example 11 | Comparative Example 5 | Comparative Example 6 | Reference Example 2 | Reference Example 3 | Comparative Example 7 |
|---|---|---|---|---|---|---|---|---|---|---|
| Amount in terms of metal | mass % | (0.08) | (0.08) | (0.08) | (0.08) | (0.08) | (0.08) | (0.08) | (0.08) | (0.08) |
| (D) Ashless dispersant[11)] | mass % | 5 | 5 | 5 | 5 | 5 | 5 | 5 | 5 | 5 |
| (E) Anti-oxidant[12)] | mass % | 2 | 2 | 2 | 2 | 2 | 2 | 2 | 2 | 2 |
| Viscosity index improver[13)] | mass % | 4 | 4 | 4 | 4 | 4 | 4 | 4 | 4 | 4 |
| Demulsifier[14)] | mass % | 0.01 | 0.01 | 0.01 | 0.01 | 0.01 | 0.01 | 0.01 | 0.01 | 0.01 |
| Properties of composition | | | | | | | | | | |
| total sulfur content | mass % | 0.09 | 0.1 | 0.09 | 0.09 | 0.2 | 0.2 | 0.01 | 0.01 | 0.2 |
| phosphorus content | mass % | 0.05 | 0.08 | 0.05 | 0.05 | 0.05 | 0.08 | 0.1 | 0.05 | 0.05 |
| sulfated ash content | mass % | 0.45 | 0.45 | 0.45 | 0.38 | 0.46 | 0.45 | 0.45 | 0.45 | 0.46 |
| Friction coefficient (SRV), 80° C. | | 0.045 | 0.041 | 0.062 | 0.044 | 0.074 | 0.073 | 0.156 | 0.152 | 0.072 |

[1)]hydro-refined mineral oil, total aromatic content: 1.2 mass %, sulfur content: 10 mass ppm, 100° C. kinematic viscosity: 5.6 $mm^2/s$, viscosity index: 125, NOACK eveporation loss: 8 mass %

[2)]zinc di(n-butyl)phosphate, phosphorus content: 13.2 mass %, sulfur content: 0 mass %, zinc content: 13 mass %, sulfated ash content: 19.5 mass %

[3)]tri(2ethylhexyl)phosphate, phosphorus content: 7.1 mass %, sulfur content: 0 mass %

[4)]alkyl group: secbutyl/sechexyl, phosphorus content: 7.2 mass %, sulfur content: 15.2 mass %, zinc content: 7.8 mass %, sulfated ash content: 11.7 mass %

[5)]molybdenum dithiocarbamate, Mo content: 4.5 mass %, sulfur content: 5.0 mass %, sulfated ash content: 6.8 mass %

[6)]molybdenum dithiophosphate, Mo content: 9.0 mass %, sulfur content: 10.5 mass %, phosphorus content: 3.3 mass %, sulfated ash content: 13.5 mass %

[7)]molybdenum phosphate, Mo content: 6.5 mass %, sulfur content: 0 mass %, phosphorus content: 4.6 mass %, sulfated ash content: 9.8 mass %

[8)]molybdenum amine complex, Mo content: 4.6 mass %, sulfur content: 0 mass %, sulfated ash content: 6.9 mass %

[9)]calcium salicylate, base number: 120 mgKOH/g, Ca content: 4 mass %, metal ratio: 1.0, sulfated ash content: 13.6 mass %

[10)]calcium salicylate, base number: 120 mgKOH/g, Ca content: 4 mass %, metal ratio: 2.7, sulfated ash content: 13.6 mass %

[11)]polybutenyl succinimide, number-average molecular weight of polybutenyl group: 1,300

[12)]octyl-3-(3,5-di-tert-butyl-4-hydroxyphenyl)propionate and alkyldiphenylamine (1:1)

[13)]OCP, weight average molecular weight: 150,000

[14)]polyalkylene glycol-based

As apparent from the results shown in Table 4, the lubricating oil compositions of the present invention (Examples 8 to 11) exhibited excellent low friction properties. Particularly, the composition containing a metallic detergent whose metal ratio was 2.3 or less (Examples 8, 9 and 11) exhibited a more excellent friction reducing effect than that containing a metallic detergent whose metal ratio is more than 2.3 (Example 10). It was also confirmed that a lubricating oil composition obtained using zinc di(2ethylhexyl)monothiophosphate in an amount of 0.05 percent by mass in terms of phosphorus instead of Component (A) of the composition of Example 9 was 0.048 in the above-described friction test and thus excelled in friction reducing effect. Whereas, the compositions containing zinc dithiophosphate instead of Component (A) (Comparative Examples 5, 6 and 7) and those containing a sulfur-free organic molybdenum complex instead of Component (F) (Reference Examples 2 and 3) were high in friction coefficient.

It was confirmed that these lubricating oil compositions of the present invention exhibited an excellent friction reducing effect when they were used in an engine equipped with a direct striking bucket type or roller follower type valve train system. Furthermore, these lubricating oil compositions of the present invention are free from sulfuric acid formation caused by the decomposition of zinc dithiophosphate, compared with those containing zinc dithiophosphate and thus can suppress an organic molybdenum compound from deteriorating. Therefore, the compositions of the present invention are excellent in initial friction reducing effect as well as the retention properties thereof and also excellent in long-drain properties such as oxidation stability and base number retention properties and high-temperature detergency.

APPLICABILITY IN THE INDUSTRY

The lubricating oil composition of the present invention exhibits an extremely excellent friction reducing effect and can achieve the low contents of sulfur, ash, and phosphorus as well as excellent long-drain properties. Therefore, the lubricating oil composition of the present invention can be used not only as a lubricating oil for internal combustion engine but also as those required to have these properties, such as lubricating oils for automatic or manual transmission driving mechanisms, greases, wet brake oils, hydraulic oils, turbine oils, compressor oils, bearing oils, refrigerating oils, or the like.

The invention claimed is:

1. A lubricating oil composition consisting of a base oil; at least one type of phosphorus compound Component (A) comprising metal salts of phosphorus compounds represented by formula (2) below; at least one type of additive selected from the group consisting of Component (C) consisting of a metal detergent consisting of an alkali metal salicylate or an alkaline earth metal salicylate, Component (D) comprising ashless dispersants comprising polybutenylsuccinimides, and Component (E) comprising anti-oxidants comprising phenol-based antioxidants and/or amine-based antioxidants; and at least one type of additive selected from the group consisting of Component (F) comprising a sulfur-containing organic molybdenum complex and Component (G) comprising an ashless friction modifier comprising fatty esters and/or amine compounds:

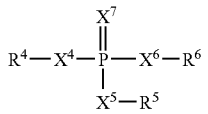

(2)

wherein $X^4$, $X^5$, $X^6$, and $X^7$ are each oxygen and $R^4$, $R^5$, and $R^6$ are each independently hydrogen or a hydrocarbon group having 1 to 30 carbon atoms provided that at least one of $R^4$, $R^5$, and $R^6$ is a hydrocarbon group having 1 to 30 carbon atoms; the composition fulfilling one requirement selected from the group consisting of the following requirements:

(II) the composition contains a phosphorus compound selected from Components (A) as the main component, Component (F) in an amount of 0.001 to 0.2 percent by mass in terms of molybdenum based on the total mass of the composition, and sulfated ash in amount of 1.2 percent by mass or less; or (III) the composition contains a phosphorus compound selected from Components (A) as the main component, Component (G) and sulfated ash in an amount of 1.2 percent by mass or less;

wherein the composition contains no zinc dithiophosphates and a NOACK evaporation loss of the base oil is 16 percent by mass or less.

2. The lubricating oil composition according to claim 1 wherein the content of Component (A) is from 0.005 to 0.08 percent by mass in terms of phosphorus based on the total mass of the composition.

3. The lubricating oil composition according to claim 1 wherein the content of Component (C) is from 0.01 to 0.15 percent by mass in terms of metal based on the total mass of the composition.

4. The lubricating oil composition according to claim 1 wherein Component (C) comprises a metallic detergent having a metal ratio adjusted to 2.3 or less.

5. The lubricating oil composition according to claim 1 wherein Component (G) is a fatty acid ester-based friction modifier having a hydrocarbon group having 6 to 30 carbon atoms.

6. The lubricating oil composition according to claim 1 wherein the sulfated ash content of the composition is 0.6 percent by mass or less.

7. The lubricating oil composition according to claim 1 wherein the total aromatic content and sulfur content of the lubricating base oil are 3 percent by mass or less and 0.05 percent by mass or less, respectively.

8. A method for lubricating an internal combustion engine equipped with a direct striking bucket type or roller follower type valve train system wherein the lubricating oil composition according to claim 1 is contacted with said mechanism.

9. The method according to claim 8 wherein said internal combustion engine uses a fuel whose sulfur content is 50 ppm by mass or less.

10. The lubricating oil composition according to claim 1, wherein the metal salt of Component (A) is a zinc salt.

11. The lubricating oil composition according to claim 1, wherein each hydrocarbon group of $R^4$, $R^5$, and $R^6$ in formula (2) of Component (A) is an alkyl group having 3 to 18 carbon atoms.

12. The lubricating oil composition according to claim 1, wherein Component (C) comprises calcium salicylate.

13. The lubricating oil composition according to claim 1, wherein Component (F) comprises a molybdenum dithiophosphate and/or molybdenum dithiocarbamate.

14. The lubricating oil composition according to claim 1, wherein the composition comprises Component (C), Component (D), and Component (E).

15. A lubricating oil composition consisting of a base oil; Component (A) comprising zinc salts of phosphorus compounds represented by formula (2) below; Component (C) consisting of a metal detergent consisting of calcium salicylate; Component (D) comprising ashless dispersants comprising polybutenylsuccinimides; Component (E) comprising anti-oxidants comprising phenol-based antioxidants and/or amine-based antioxidants; and at least one type of additive selected from the group consisting of Component (F) comprising a sulfur-containing organic molybdenum complex comprising a molybdenum dithiophosphate and/or molybdenum dithiocarbamate and Component (G) comprising an ashless friction modifier comprising a fatty acid ester:

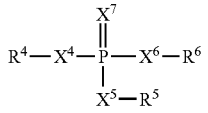

(2)

wherein $X^4$, $X^5$, $X^6$, and $X^7$ are each oxygen, and $R^4$, $R^5$, and $R^6$ are each independently hydrogen or an alkyl group having 3 to 18 carbon atoms provided that at least one of them is an alkyl group having 3 to 18 carbon atoms; and wherein the composition contains sulfated ash in an amount of 1.2 percent by mass or less and no zinc dithiophosphates.

16. A lubricating oil composition consisting of a base oil; Component (A) comprising zinc salts of phosphorus compounds represented by Formula (2) below; Component (C) consisting of a metal detergent consisting of calcium salicylate; Component (D) comprising ashless dispersants comprising polybutenylsuccinimides; and Component (E) comprising antioxidants comprising phenol-based antioxidants and/or amine-based antioxidants:

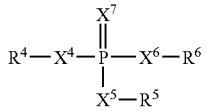

(2)

wherein $X^4$, $X^5$, $X^6$, and $X^7$ are each oxygen, and $R^4$, $R^5$, and $R^6$ are each independently hydrogen or an alkyl group having 3 to 18 carbon atoms provided that at least one of them is an alkyl group having 3 to 18 carbon atoms; and wherein the composition contains sulfated ash in an amount of 1.2 percent by mass or less and no zinc dithiophosphates.

* * * * *